United States Patent [19]

Moses

[11] 4,291,784

[45] Sep. 29, 1981

[54] COMPACT, QUICK ASSEMBLY SCAFFOLD

[76] Inventor: Owen L. Moses, 315 Oregon Trail, Monroe, La. 71202

[21] Appl. No.: 130,546

[22] Filed: Mar. 14, 1980

[51] Int. Cl.[3] ..... E04G 1/14

[52] U.S. Cl. ..... 182/178; 182/117; 182/179

[58] Field of Search ..... 182/178, 179, 118, 119, 182/180, 117, 229; 52/637, 638

[56] References Cited

U.S. PATENT DOCUMENTS

| | | | |
|---|---|---|---|
| 2,593,122 | 4/1952 | Droeger | 182/180 |
| 2,818,308 | 12/1957 | Williams | 182/179 |
| 2,879,552 | 3/1959 | Torrance | 52/637 |
| 2,897,013 | 7/1959 | Delp | 182/108 |
| 3,084,761 | 4/1963 | Robertson | 182/178 |
| 3,340,959 | 9/1967 | Wilson | 182/119 |
| 3,340,960 | 9/1967 | Wilson | 182/117 |
| 3,490,559 | 1/1970 | Torch | 182/119 |
| 3,684,058 | 8/1972 | Brown | 182/132 |
| 3,690,407 | 9/1972 | Cullison | 182/119 |
| 3,850,264 | 11/1974 | Salinas | 182/178 |

FOREIGN PATENT DOCUMENTS

| | | | |
|---|---|---|---|
| 1137122 | 12/1968 | United Kingdom | 182/178 |

*Primary Examiner*—Reinaldo P. Machado
*Attorney, Agent, or Firm*—David L. Ray; Edgar E. Spielman, Jr.

[57] ABSTRACT

A scaffold assembly including a ladder unit having an outside vertical member with a hollow top end and bottom end, an inside vertical member connected to the outside vertical member by horizontal steps, the top step and the bottom step having a hollow end adjacent to the point at which they are connected to the inside vertical member, the hollow top end and bottom end of the outside vertical member being adapted for connecting to another ladder unit by placing a pin in the hollow portions of the two vertical ladder units, the ladder unit being adapted for joining side by side to another ladder unit by placing a horizontal joining member in the open ends of the top and bottom steps to join the two ladder units horizontally side by side.

1 Claim, 4 Drawing Figures

COMPACT, QUICK ASSEMBLY SCAFFOLD

BACKGROUND OF THE INVENTION

The present invention relates generally to the field of scaffolding, in particular, to the ground-supported type. Even more particularly, the present invention is related to a scaffold that may be disassembled into components of small size which may be easily carried through a small opening such as an entrance to a large boiler or other vessel and easily assembled inside the vessel. The present invention is also related to scaffolds which may be easily erected with a minimum of time to the desired height in selected locations, and to the method of assembling same.

The need for providing supports for materials such as brick, mortar, cleaning equipment, sand-blasting equipment, and the like, as well as elevated supports for workmen or masons engaged in erection of building walls, has resulted in the development of a wide range of scaffolding structures providing such support. Exemplary of such scaffolds are those disclosed in U.S. Pat. Nos. 2,593,122; 2,897,013; 3,684,058; 3,690,407; and 3,850,264.

However, there has long been a need for an easily transportable and easily assembled scaffold which may be carried inside small entrances or man-ways such as are found in the entrance to large vessels or boilers used in various industrial applications. Frequently the entrance way is only large enough for one man to enter at a time. Furthermore, inside such vessels the area to work in may be confined and thus make it difficult and time consuming to build a scaffold from conventional materials such as lumber and the like. Furthermore, if a scaffold is built from lumber then it must be completely torn down for the pieces to be carried out of the vessel through small man-ways.

Thus, it is highly desirable for a small, compact, easily assembled scaffold to be provided for utilization in such situations. The scaffold of the present invention is ideally suited for use in such applications. The various components of the scaffold of the invention can be made very compact so that they are easily carried through a small man-way. Furthermore, the components are very easily assembled and assembly can be accomplished rapidly. Furthermore, by assembling the various components of the scaffold together the scaffold can be made as tall as desired or of virtually any desired dimension.

SUMMARY OF THE INVENTION

In accordance with the invention, there is provided a scaffold assembly including a ladder unit having an outside vertical member with a hollow top end and bottom end, an inside vertical member connected to the outside vertical member by horizontal steps, the top step and the bottom step having a hollow end adjacent to the point at which they are connected to the inside vertical member, the hollow top end and bottom end of the outside vertical member being adapted for connecting to another ladder unit by placing a pin in the hollow portions of the two vertical ladder units, the ladder unit being adapted for joining side by side to another ladder unit by placing a horizontal joining member in the open ends of the top and bottom steps to join the two ladder units horizontally side by side.

DESCRIPTION OF THE PREFERRED EMBODIMENTS

Figure 1:
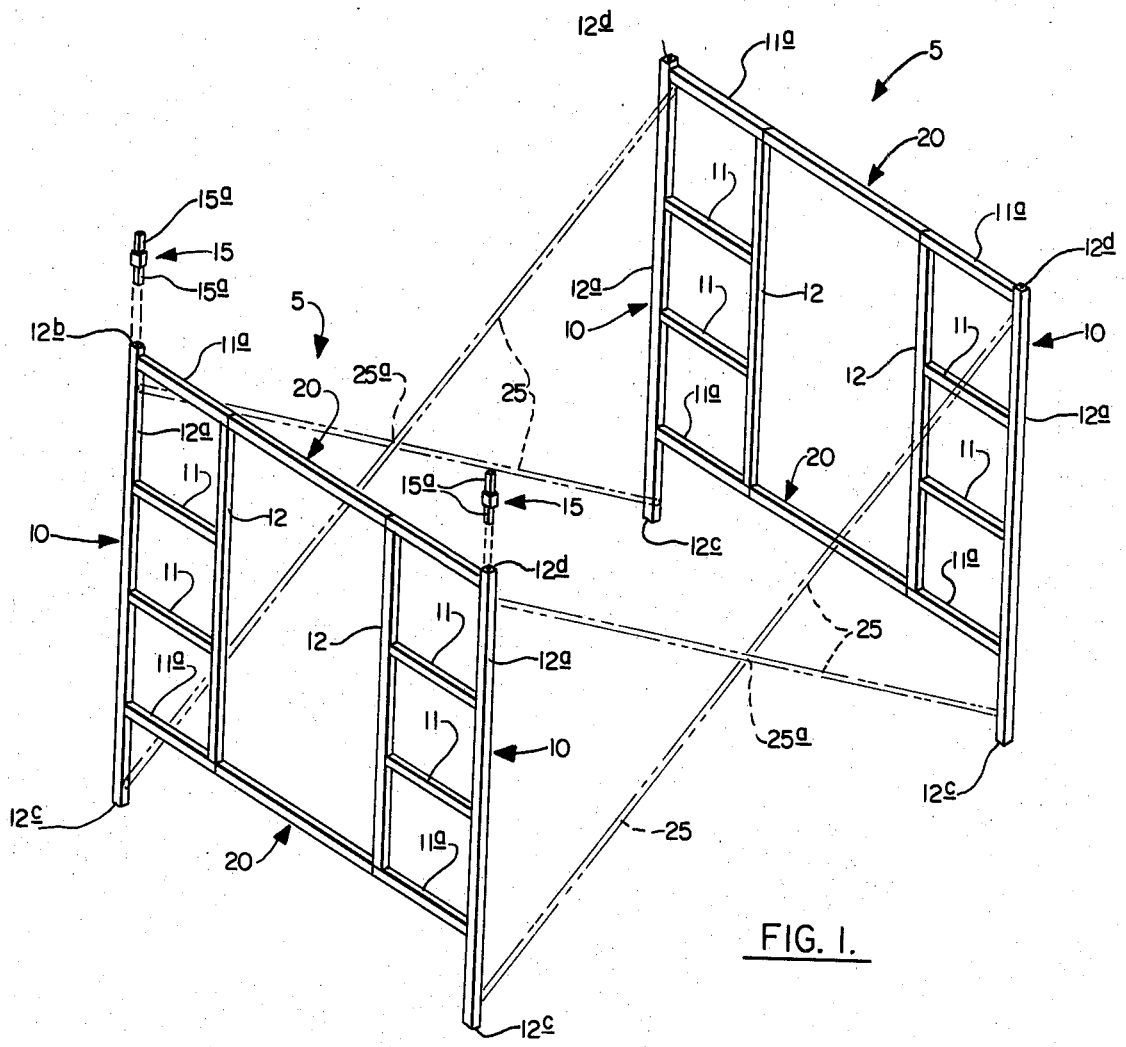
FIG. 1 is a perspective, partly exploded view of the scaffold assembly of the present invention.
Figure 2:
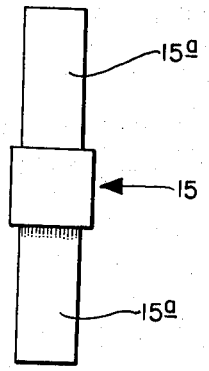
FIG. 2 is a plan view of a pin of the scaffold assembly of the present invention.

Referring now to the drawings, in FIG. 1 is seen assembled sections of scaffolding prepared in accordance with the present scaffolding assembly. As can be seen in the drawing, the two assembled end sections of the scaffold are indicated generally by the numeral 5. These two identical assembled end sections are joined by braces 25 which are shown "ghosted in". Braces 25 are shown "ghosted in" because any suitable support or cross pieces for joining the two end sections 5 together may be utilized. The braces 25 could be attached horizontally to the top ends if desired. Also, the braces may be pinned in the middle as indicated at 25*a* or the methods well-known in the art as indicated in the previously mentioned patents for connecting sections of scaffolding could be utilized.

Figure 3:
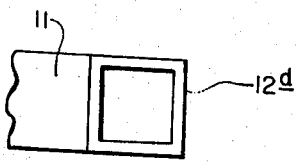
FIG. 3 is an end view of a hollow end of the vertical member of the scaffold; and, FIG. 4 is a partly sectional, exploded view showing the method of assembly of the scaffold of the present invention.
Figure 4:
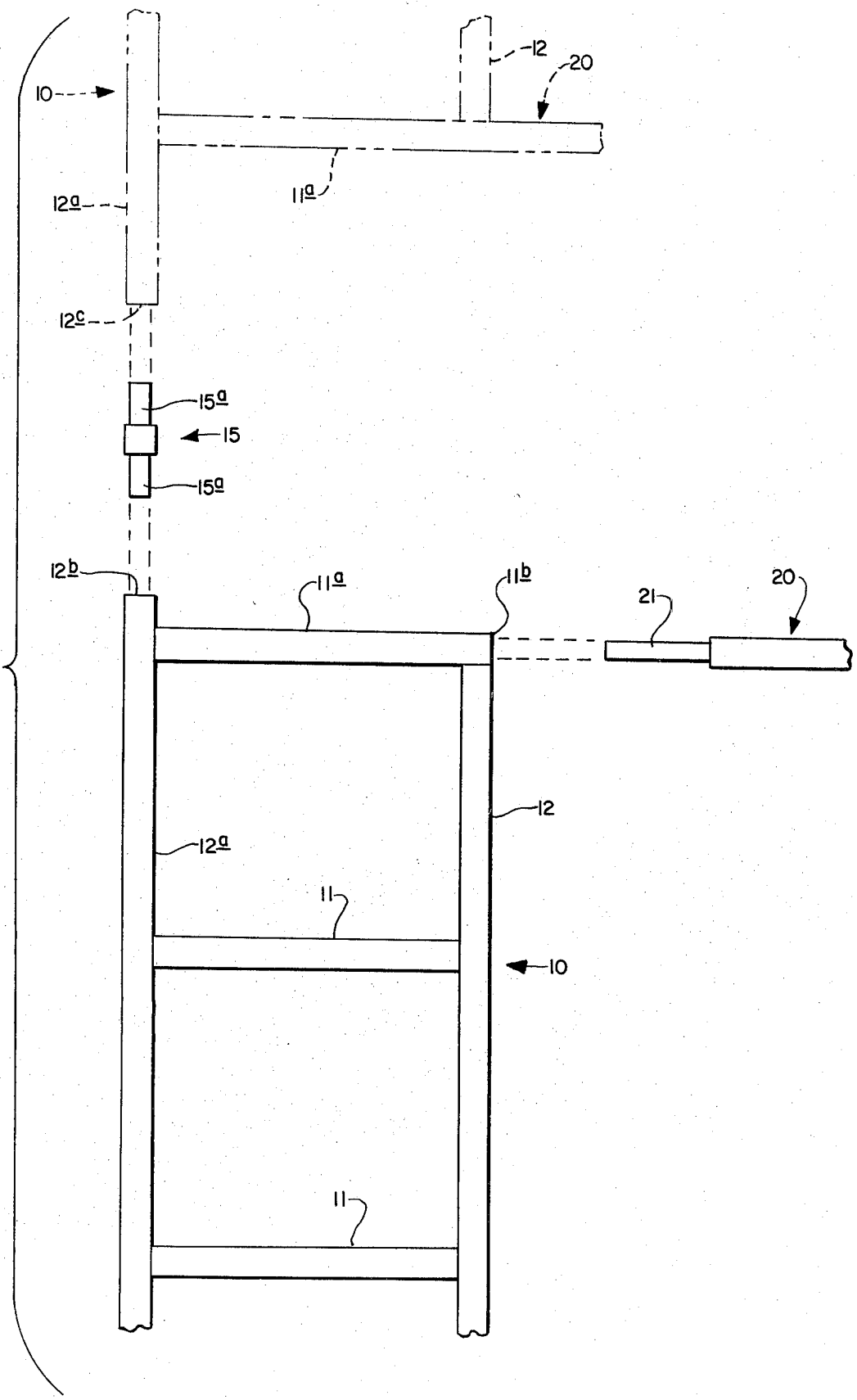

As can be seen in FIGS. 1 and 4, the end sections 5 include a ladder unit generally indicated by the numeral 10. Laddar unit 10 is a rigid unit including two vertical members 12 and 12*a*. Vertical member 12 is the inside vertical member and is attached to the outside vertical member 12*a* by a series of horizontal steps 11 and 11*a*. Outside vertical member 12*a* is hollow at the top end 12*b* and the bottom end 12*c*. Ends 12*b* and 12*c* have substantially the same shape and cross-sectional configuration. The preferred embodiment of the present invention as is shown in FIG. 3 at 12*b* is indicated as rectangular in cross-section. However, if desired, the end 12*b* could be changed to any desired configuration such as an oval or a circle.

Attached at the top end and the bottom end of 12*a* are steps 11*a* which have a hollow end 11*b* as shown in FIG. 4 for receipt of the horizontal joining member indicated generally by the numeral 20. Horizontal joining member 20 has a reduced end portion 21 shown in FIG. 4 which is slidably received inside the hollow end 11*b* of steps 11*a*.

Thus, to assemble two ladder units 10 in a side by side configuration, the two ladder units are aligned in a plane with the inside vertical members 12 facing each other, and two horizontal joining members 20 are inserted at the top and the bottom into ends 11*b* of steps 11*a*. Thus, an assembled end section generally indicated by numeral 5 in FIG. 1 is achieved.

To assemble another end section vertically to one of the end sections shown in FIG. 1, a pin 15 having reduced end portions 15*a* is fitted into the top end 12*b* as shown in FIG. 4 and the bottom end 12*c* of assembled sections 5. Thus, the sections can be stacked in the same plane in a vertical manner.

As previously mentioned, the adjacent sections as shown in FIG. 1 can be attached together with any conventional braces such as those indicated at 25. Furthermore, if it is desired, holes may be drilled into steps 11*a* and the ends 21 of horizontal joining member 20 so that a pin may be placed through the holes to prevent horizontal joining member 20 from being slipped out of step 11*a*. In addition, the horizontal joining members 20 may be sized so that they will fit completely inside of the outside vertical member 12*a* for easy transportability.

The various components of the scaffold assembly of the present invention may be made of any desired material such as steel, aluminum, or the like. Aluminum is preferred since it is lightweight and easily transportable by the workmen through small areas.

Although the preferred embodiments of the present invention have been disclosed and described in detail above, it should be understood that the invention is in no sense limited thereby and its scope to be determined by that of the following claims.

What is claimed:

1. A ladder unit for use in constructing a scaffold comprising:

a. an outside vertical member having a top and a bottom end, said top end and said bottom end being rectangular in cross-section and hollow for receipt of a pin means therein for joining one of said ladder units vertically to another of said ladder units;

b. an inside vertical member;

c. pin means comprising a rigid elongated structure having two end portions adapted to be slidably and snugly received in said hollow top or bottom end of said outside vertical member, said end portions being rigidly connected to a center portion which is sufficiently large enough to prevent said center portion from sliding into said hollow ends of said outside vertical member;

d. a series of horizontal two-ended step means rigidly connected at one end to said outside vertical member and at the other end to said inside vertical member, the steps located at said top end and said bottom end of said outside vertical member being rectangular in cross-section and hollow at said end which is connected to said inside vertical member for receipt of horizontal joining means for joining two of said ladder units side by side; and e. horizontal joining means comprising a rigid elongated structure having two end portions adapted to be slidably and snugly received in said hollow ends of said step means at the top or bottom end of said outside vertical member, said two end portions being rigidly connected to an elongated center portion which is sufficiently large enough to prevent said center portion from sliding into said hollow ends of said outside vertical member and sufficiently long enough to achieve the desired horizontal spacing between two connected side-by-side ladder units.

* * * * *